US007015904B2

(12) United States Patent
Kim

(10) Patent No.: US 7,015,904 B2
(45) Date of Patent: Mar. 21, 2006

(54) POWER SEQUENCE APPARATUS FOR DEVICE DRIVING CIRCUIT AND ITS METHOD

(75) Inventor: Chang Gone Kim, Taegu-shi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 149 days.

(21) Appl. No.: 10/025,477

(22) Filed: Dec. 26, 2001

(65) Prior Publication Data

US 2003/0034965 A1 Feb. 20, 2003

(30) Foreign Application Priority Data

Aug. 14, 2001 (KR) ..... P2001-49076

(51) Int. Cl.
*G09G 5/00* (2006.01)

(52) U.S. Cl. ..... 345/212; 345/213; 345/94

(58) Field of Classification Search ..... 345/87–101, 345/204, 211, 212, 213
See application file for complete search history.

(56) References Cited

U.S. PATENT DOCUMENTS

| | | | | |
|---|---|---|---|---|
| 5,754,155 | A * | 5/1998 | Kubota et al. | 345/98 |
| 5,784,039 | A * | 7/1998 | Yasui et al. | 345/89 |
| 5,940,055 | A * | 8/1999 | Lee | 345/87 |
| 6,373,456 | B1 * | 4/2002 | Matsubara | 345/94 |
| 6,421,038 | B1 * | 7/2002 | Lee | 345/98 |
| 6,486,864 | B1 * | 11/2002 | Nakajima et al. | 345/92 |
| 6,509,894 | B1 * | 1/2003 | Maekawa et al. | 345/211 |
| 6,661,401 | B1 * | 12/2003 | Sekine | 345/92 |
| 2001/0033266 | A1 * | 10/2001 | Lee | 345/94 |

* cited by examiner

*Primary Examiner*—Amr A. Awad
(74) *Attorney, Agent, or Firm*—Birch, Stewart, Kolasch & Birch, LLP

(57) ABSTRACT

A power sequence apparatus and a driving method that renders the control of a power sequence easy and prevents malfunction in a driver IC. The power sequence apparatus includes a power supply for simultaneously generating a gate high voltage and a gate low voltage, a gate driving circuit sequentially supplying the gate high voltage and then the gate low voltage to gate lines, and a voltage controller disposed between the power supply and the gate driving circuit, and processing the gate high voltage using multiple switching circuits to supply the gate high voltage to the gate driving circuit after the gate low voltage is supplied to the gate driving circuit.

20 Claims, 5 Drawing Sheets

POWER SEQUENCE APPARATUS FOR DEVICE DRIVING CIRCUIT AND ITS METHOD

RELATED APPLICATION

The present application claims the benefit of Korean Patent Application No. P2001-49076 filed Aug. 14, 2001, which is herein fully incorporated by reference.

BACKGROUND OF THE INVENTION

1. Field of the Invention

This invention relates to a power supply device and, more particularly, to a power sequence apparatus and a driving method for controlling a power sequence with ease and preventing the malfunction of a driver IC.

2. Description of the Related Art

A liquid crystal display (LCD) of an active matrix system uses thin film transistors (TFTs) as switching devices to display a moving picture. Since such an LCD can be made into a device small in size compared to the existing Brown tubes, it has been widely used in a monitor of a personal computer or a notebook computer, in an office automation equipment such as a copy machine, etc. and in a portable equipment such as a cellular phone and a pager, etc.

Referring to FIG. 1, a conventional liquid crystal display includes a data driver 4 for driving data lines DL on a liquid crystal display panel 2, a gate driver 6 for driving gate lines GL on the liquid crystal display panel 2, a timing controller 8 for supplying control signals, data signals and scan signals to the data driver 4 and the gate driver 6, and a power block 10 for supplying a driving voltage to the gate driver 10 through output lines 10*a* and 10*b*.

The liquid crystal display panel 2 displays a picture corresponding to a video signal similar to a television signal through pixels 11 that are arranged at each intersection of the data lines DL and the gate lines GL. Each of the pixels 11 includes a liquid crystal cell controlling the amount of a transmitted light in accordance with the voltage level of the data signal from the corresponding data line DL. A plurality of TFTs are arranged at the intersections of the gate lines GL and the data lines DL, and respond to the scan signal (gate pulse) from the gate line GL to switch the data signal to be transmitted to the corresponding liquid crystal cell.

The timing controller 8 receives a driving voltage from a system main board (not shown). The timing controller 8 supplies video data (R, G and B Data) and the control signals (e.g., input clock, horizontal synchronization signal, data enable signal, etc.) inputted from an interface (not shown), to the data driver 4 including a plurality of drive ICs and to the gate driver 6 including a plurality of gate drive ICs.

The data driver 4 selects a reference gamma voltage corresponding to the video data (R, G and B Data) inputted from the timing controller 8, converts it to an analog video signal, and supplies the analog video signal to the liquid crystal display panel 2.

The gate driver 6 controls line by line the on/off state of the gate terminals of the TFTs arranged on the liquid crystal display panel 2 in accordance with the control signals inputted from the timing controller 8, and applies the analog video signals received from the data driver 4 to each of the pixels 11 connected to each of the TFTs.

The power block 10 receives driving power from a system main board (not shown) and generates a driving voltage for driving the gate driver 6. Particularly, the power block 10 generates a gate high voltage VGH and a gate low voltage VGL of the scanning signal and supplies them to the gate driver 6, upon the generation of a gate scanning clock signal GSC.

The gate low voltage VGL is generated from the power block 10 and directly transmitted to the gate driver 6. On the other hand, the gate high voltage VGH is supplied to the gate driver 6 after the sequence control circuit 12 disposed between the power block 10 and the gate driver 6 controls the point of its output time by delaying the output of the gate high voltage VGH to the gate driver 6 for a predetermined time. Particularly, when a main power VDD is supplied to the power block 10, the gate low voltage VGL and the gate high voltage VGH are simultaneously output from the power block 10 as shown in FIG. 2. However, because the point of the driving time is not synchronized in the gate driver 6, a malfunction occurs if it receives the gate low voltage VGL and the gate high voltage VGH simultaneously. To address this concern, the output of the gate high voltage VGH is delayed for a time period T through the sequence control circuit 12 so that the gate driver 6 receives the gate low voltage VGL first and then the gate high voltage VGH.

Referring to FIG. 3, the sequence control circuit 12 includes an integrator consisting of a resistor R and a capacitor C between the gate driver 6 and the output line 10*b* of the gate high voltage VGH of the power block 10.

The resistor R and the capacitor C are disposed between the power block 10 and a ground voltage source GND. Such an integrator delays the point of the output time of the gate high voltage VGH from the power block 10 for as much as a time period 'T'. In other words, the integrator plays a role of simply delaying the gate high voltage VGH for a predetermined time.

As described above, when the main power VDD is supplied to the power block 10, the power block 10 outputs the gate low voltage VGL, and the gate high voltage VGH that is delayed as much as the time T compared to the gate low voltage VGL. But, when the main power VDD is removed once it has been applied to the power block 10, the electric potential at the output line 10*b* of the gate high voltage VGH becomes high so that the voltage charged at the capacitor C is discharged slowly. At this moment, when the main power is supplied again, the voltage, yet to be discharged completely, and the voltage currently supplied are added together such that a gate high voltage VGH is supplied to the gate driver 6 before the gate driver 6 receives the gate low voltage VGL. This causes malfunctions in the gate driver 6.

SUMMARY OF THE INVENTION

Accordingly, it is an object of the present invention to provide a power sequence apparatus and a driving method that makes the control of a power sequence easier and is capable of preventing the malfunction of a driver IC.

In order to achieve these and other objects of the invention, a power sequence apparatus according to one aspect of the present invention includes a power supply for generating a gate high voltage and a gate low voltage; a gate driving circuit sequentially supplying the gate high voltage and the gate low voltage to a gate electrode; and a voltage control circuit disposed between the power supply and the gate driving circuit, and switching the gate high voltage for supplying the gate high voltage after the gate low voltage is supplied to the gate driving circuit upon the initial drive of the power supply.

In the power sequence apparatus, the voltage control circuit includes a first switching device disposed between the power supply and the gate driving circuit to switch to the gate driver the gate high voltage that is output from the power supply; a second switching device connected between the first switching device and a gate low voltage output line of the power supply to control the point of the switching time of the first switching device; a first resistor and a capacitor connected in parallel between the second switching device and the gate low voltage output line for switching the second switching device by a RC time constant; and a second resistor connected between the second switching device and a ground voltage source for discharging the charged voltage of the capacitor to the ground voltage source.

In the power sequence apparatus, the first switching device and the second switching device are integrated into one chip.

The power sequence apparatus further includes a current control resistor connected between the first switching device and the second switching device for controlling the switching speed of the first switching device and protecting it at the same time.

A power sequence apparatus includes a power supply for generating a gate high voltage and a gate low voltage; a gate driving circuit sequentially supplying the gate high voltage and the gate low voltage to a gate electrode; a switching part disposed between the power supply and the gate driving circuit, and switching the gate high voltage for supplying the gate high voltage after the gate low voltage is supplied to the gate driving circuit upon the initial drive of the power supply; and a timing control part generating a switching control signal for controlling the switching action of the switching part.

In the power sequence apparatus, the switching part includes a first switching device connected between the power supply and the gate driving circuit for switching to the gate driver the gate high voltage that is output from the power supply; and a second switching device connected between the first switching device and a gate low voltage output line of the power supply for controlling the point of the switching time of the first switching device by a switching control signal from the timing control part.

In the power sequence apparatus, the timing control part supplies a timing control signal to the switching part after a driving voltage being supplied to the power supply and then the gate low voltage being supplied to the gate driving circuit.

A method of driving a power sequence apparatus according to another aspect of the present invention includes the steps of generating a gate high voltage and a gate low voltage; supplying a gate high voltage to the gate driving circuit by using a switching device switching the gate high voltage after supplying the gate low voltage to a gate driving circuit; and sequentially supplying the gate low voltage and the gate high voltage to a plurality of gate electrodes.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENTS

Figure 1:
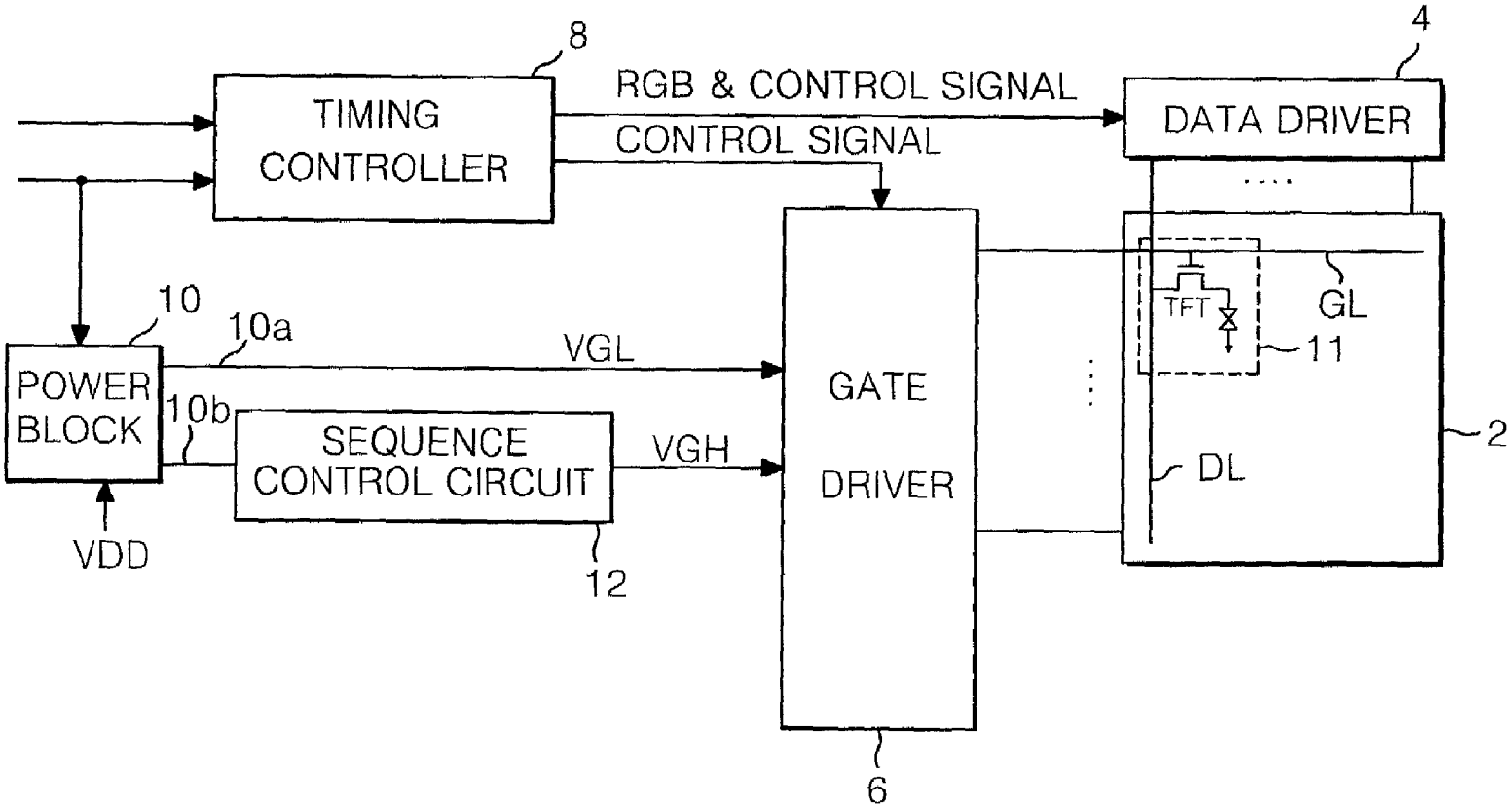
FIG.1 CONVENTIONAL ART
FIG. 1 is a block diagram of a conventional liquid crystal display.
Figure 2:
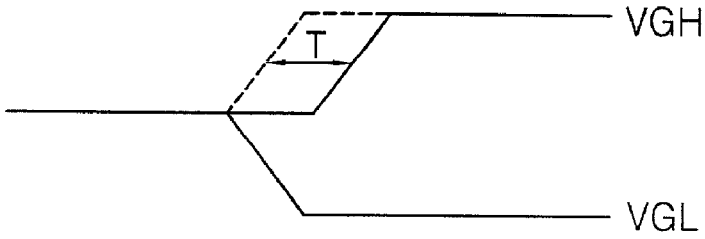
FIG.2 CONVENTIONAL ART
FIG. 2 is a waveform diagram depicting a conventional gate driving voltage signal used in the LCD of FIG. 1.
Figure 3:
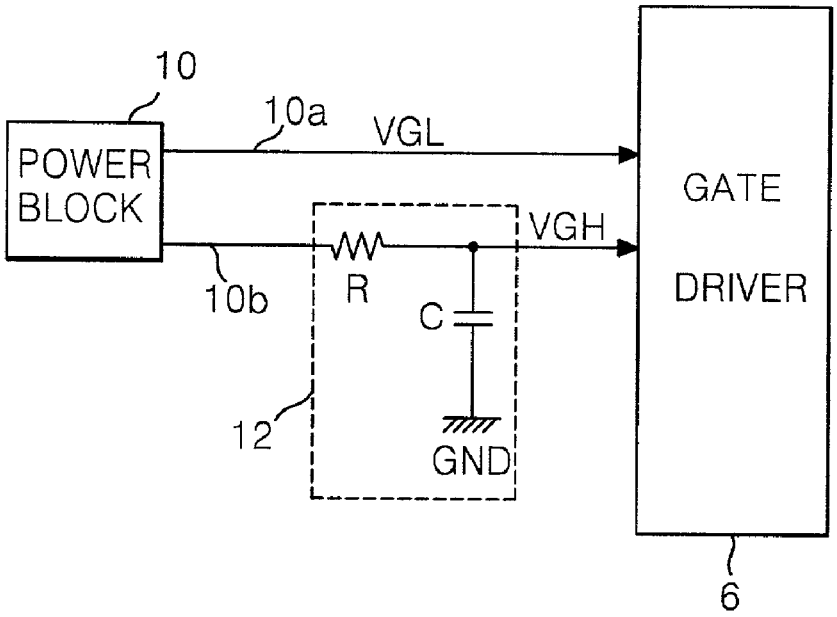
FIG.3 CONVENTIONAL ART
FIG. 3 is a circuit diagram representing a conventional sequence control circuit for adjusting the output time of the gate driving voltage shown in FIG. 2.

With reference to FIGS. 4 to 7, preferred embodiments of the present invention are explained as followings. The same reference numerals are used to represent the same elements.

Figure 4:
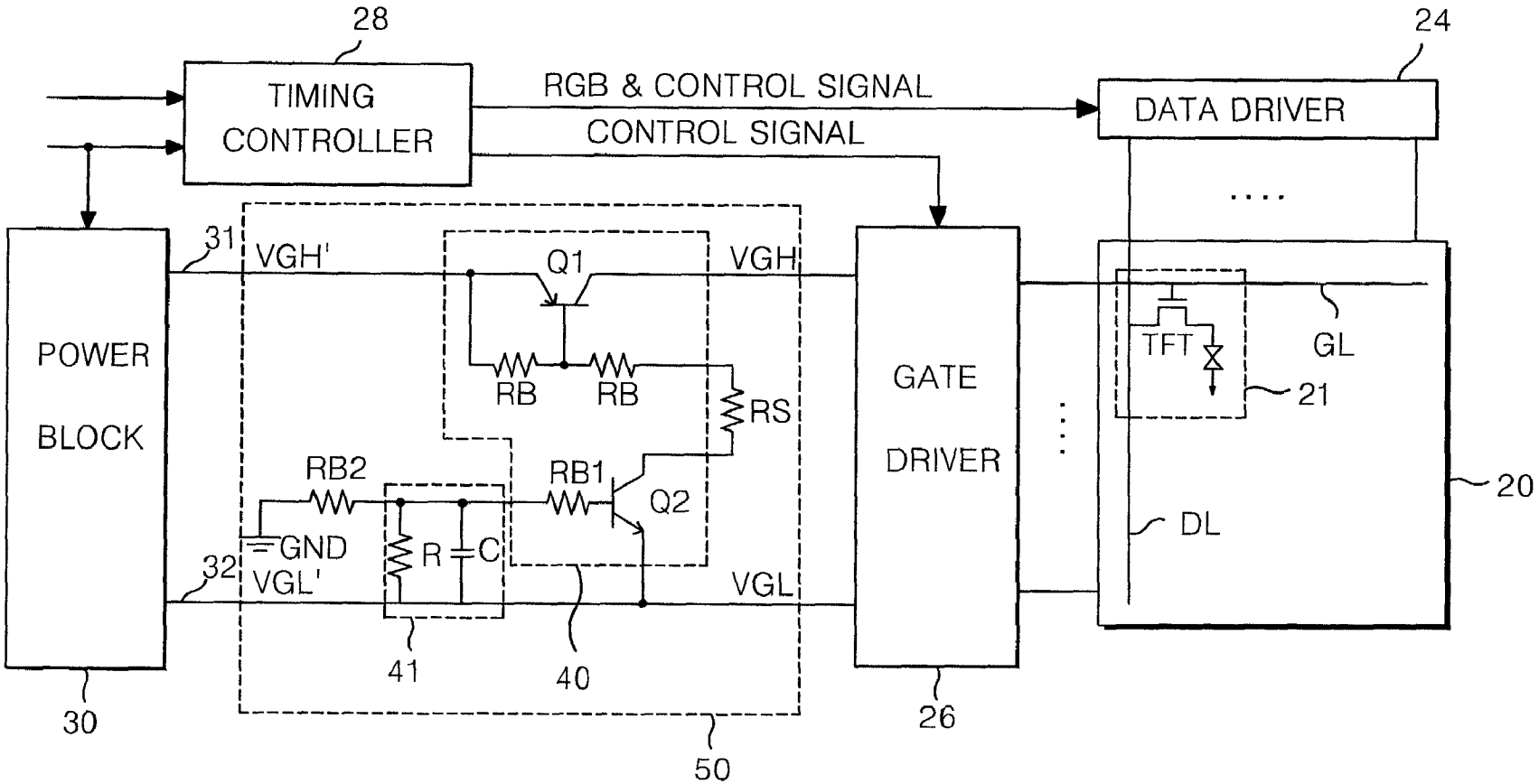
FIG. 4 is a block diagram of a power sequence apparatus usable with a liquid crystal display according to a first embodiment of the present invention.

Referring to FIG. 4, a liquid crystal display according to a first embodiment of the present invention includes a data driver 24 for driving a plurality of data lines DL on a liquid crystal display panel 20, a gate driver 26 for driving a plurality of gate lines GL on the liquid crystal display panel 20, a timing controller 28 for supplying control signals, data signals and scan signals to the data driver 24 and the gate driver 26, a power block 30 for supplying a driving voltage to the gate driver 26, and a power sequence apparatus 50 for controlling the supply sequence of the driving voltage from the power block 30 to the gate driver 26.

In the liquid crystal display panel 22, a picture corresponding to a video signal such as a television signal is displayed through a plurality of pixels 21 arranged at each of the intersections of the data lines DL and the gate lines GL. Each of the pixels 21 includes a liquid crystal cell controlling the amount of a transmission light in accordance with the voltage level of the data signal supplied from the data line DL. A TFT is arranged at each intersection of the gate lines GL and the data lines DL, and responds to the scan signal (gate pulse) from the gate line GL and switches the data signal to be transmitted to the corresponding liquid crystal cell.

The timing controller 28 receives driving power from a system main board (not shown). The timing controller 28 also supplies video data (R, G, B Data) and control signals (e.g., input clock, horizontal synchronization signal, data enable signal, etc.) inputted from an interface part (not shown), to the data driver 24 having a plurality of drive ICs and to the gate driver 26 having a plurality of gate drive ICs.

The data driver 24 selects reference gamma voltages corresponding to the video data (R, G, B Data) inputted from the timing controller 28, converts them to an analog video signal and supplies the analog video signal to the liquid crystal display panel 20 in accordance with the control signals.

The gate driver 26 controls line by line the on/off state of the gate terminals of the TFTs arranged on the liquid crystal panel 20 in correspondence to the control signals inputted from the timing controller 28, and applies the analog video signals from the data driver 24 to each of the pixels 21 connected to each of the TFTs.

The power block 30 generates a gate driving voltage composed of a gate high voltage VGH' and a gate low voltage VGL' and outputs them as voltages VGH and VGL to the gate driver 26 through output lines 31 and 32. In one embodiment, the gate high voltage VGH is around 20V and the gate low voltage VGL is around −5V. That is, the same gate high and low voltages from the power block 30 on the output lines 31 and 32 are labelled as "VGH'" and "VGL'", respectively, before they reach the circuits 40 and 41, and as "VGH" and "VGL", respectively, after they pass through the circuits 40 and 41.

The power sequence apparatus 50 delays the output of the gate high voltage VGH from the power block 30 to the gate driver 26 for a predetermined time compared to the output of gate low voltage VGL.

In particularly, the power sequence apparatus 50 according to the first embodiment of the present invention includes a sequence control circuit 40 disposed between the gate driver 26 and the gate high voltage output line 31 of the power block 30, and a RC circuit 41 disposed between the gate low voltage output line 32 and the sequence control circuit 40.

The sequence control circuit 40 includes a first P-type transistor Q1 connected between the gate driver 26 and the gate high voltage output line 31 of the power block 30 and a second N-type transistor Q2 connected between the first P-type transistor Q1 and the gate low voltage output line 32.

A bias resistor RB is connected between the emitter terminal and the base terminal of the first P-type transistor Q1, and the second N-type transistor Q2 is coupled to the base terminal of the first P-type transistor Q1. A current control resistor RS for controlling the switching speed of and protecting the first P-type transistor Q1, is connected between the base terminal of the first transistor Q1 and the second N-type transistor Q2. Another bias resistor RB is connected between the base terminal of the first transistor Q1 and the current control resistor RS.

The emitter terminal of the second N-type transistor Q2 is connected to the gate low voltage output line 32, whereas the base terminal of the second transistor Q2 is connected to the RC circuit 41. A first bias resistor RB1 is connected between the RC circuit 41 and the base terminal of the second transistor Q2.

The RC circuit 41 controls the turn-on/off point of the second N-type transistor Q2 based on its charged voltage, whereas it delays the output of the gate high voltage VGH to the gate driver 26. For this, the RC circuit 41 has a resistor R and a capacitor C disposed in parallel between the gate low voltage output line 32 and the base terminal of the second N-type transistor Q2. A second bias resistor RB2 is also connected between the resistor R and the ground voltage source GND. This second bias resistor RB2 plays a role of rapidly discharging the charged voltage of the capacitor C to the ground voltage source GND.

If a main power is supplied (e.g., from an external source) to the power block 30, the power block 30 simultaneously outputs a gate driving voltage composed of gate high and low voltages VGH' and VGL' on the output lines 31 and 32, respectively. Then the power sequence apparatus 50 transmits the gate low voltage VGL' on the gate low voltage output line 32 to the gate driver 26 immediately, and then supplies the gate high voltage VGH' on the gate high voltage output line 31 to the gate driver 26 after delaying it for a predetermined time fixed by the RC time constant of the RC circuit 41.

To describe particularly, after the main power is supplied to the power block 30, the gate low voltage VGL is supplied to the gate driver 26 from the power block 30 through the gate low voltage output line 32. At this moment, the capacitor C of the RC circuit 41 is charged with the voltage and the second N-type transistor Q2 remains at the turned-off state until this charged voltage combined with the voltage produced by a voltage drop from the first bias resistor RB1 becomes higher than a threshold voltage of the second N-type transistor Q2. Since the turned-off second transistor Q2 turns off the first transistor Q1, the gate high voltage VGH' is temporarily blocked by the turned-off state of the first P-type transistor Q1 so as not to be supplied to the gate driver 26.

Thereafter, if the voltage produced by the voltage drop in the first bias resistor RB1 combined with the charged voltage of the capacitor C becomes higher than the threshold voltage of the second N-type transistor Q2, then the second N-type transistor Q2 is turned on such that the potential difference of the base terminal of the first P-type transistor Q1 becomes lower than that of the emitter of the transistor Q1. This turns on the first P-type transistor Q1. Consequently, the gate high voltage VGH' on the gate high voltage output line 31 of the power block 30 is transmitted to the gate driver 26 through the first P-type transistor Q1.

Figure 5:
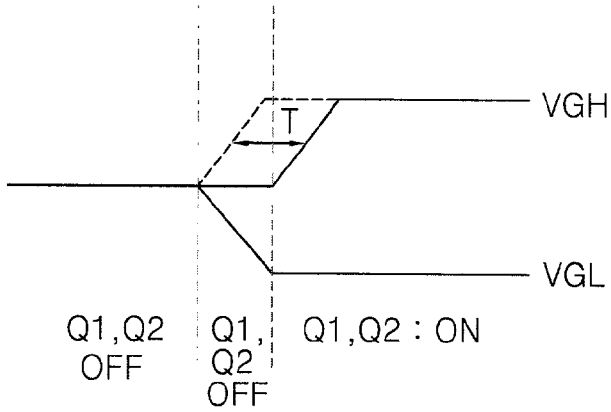
FIG. 5 is a waveform diagram representing a gate driving voltage in accordance with the drive of the power sequence apparatus shown in FIG. 4.

In the power sequence apparatus 50, the first P-type transistor Q1 and the second N-type transistor Q2 of the sequence control circuit 40 remain at the turned-off state before the main power is supplied to the power block 30 as shown in FIG. 5. If the main power is supplied thereafter, the gate low voltage VGL' and the gate high voltage VGH' are simultaneously output from the power block 30. At this moment, the gate low voltage VGL' (VGL) is immediately supplied to the gate driver 26 through the gate low voltage output line 32, whereas the gate high voltage VGH' (VGH) is not immediately supplied to the gate driver 26 because the point of its output time is delayed by the RC circuit 41.

When the gate low voltage VGL' flows in the output line 32, the second N-type transistor Q2 is turned on according to the RC time constant set by the resistor R and the capacitor C of the RC circuit 41. In accordance with the turn-on state of the second N-type transistor Q2, the threshold voltage of the base terminal of the first P-type transistor Q1 becomes lower which in turn turns on the first P-type transistor Q1. Then the gate high voltage VGH' (VGH) is supplied to the gate driver 26 through the switched-on first P-type transistor Q1. Herein, the switching speed of the first P-type transistor Q1 is determined by the current control resistor RS. That is, bigger the resistance value of the current control resistor RS is, slower the switching speed of the first P-type transistor Q1 will be, whereas smaller the resistance value of the resistor RS is, faster the switching speed of the first transistor Q1 will be.

Thus, when the main power is supplied to the power block 30, a time delay T occurs in the gate high voltage VGL being supplied as shown in FIG. 5 by the RC circuit 41. Then the first transistor Q1 and the second transistor Q2 are turned on, and then the gate high voltage VGH is supplied to the gate driver 26.

On the other hand, when the main power is removed from the power block 30, the potential difference of the gate low voltage output line 32 becomes a virtual ground and the charged voltage of the capacitor C is rapidly discharged to the ground voltage source GND through the resistor R and the second bias resistor RB2. In this way, the rapid discharge of the charged voltage of the capacitor C turns off the second N-type transistor Q2 such that the potential differences of the emitter and the base terminal of the first P-type transistor Q1 become the same which quickly turns off the first P-type transistor Q1 to block the transmission of the gate driving voltage.

Thus, the power sequence apparatus 50 according to the present invention allows the charged voltage of the capacitor C to be rapidly discharged through the resistor RB and the second bias resistor RB2 such that the gate high voltage VGH' from the power block 30 is not output to the gate driver 26 faster than the gate low voltage VGL'. As a result, malfunction of the gate driver, which is caused when the gate high voltage VGH is received before the gate low voltage VGL, is effectively prevented.

Figure 6:
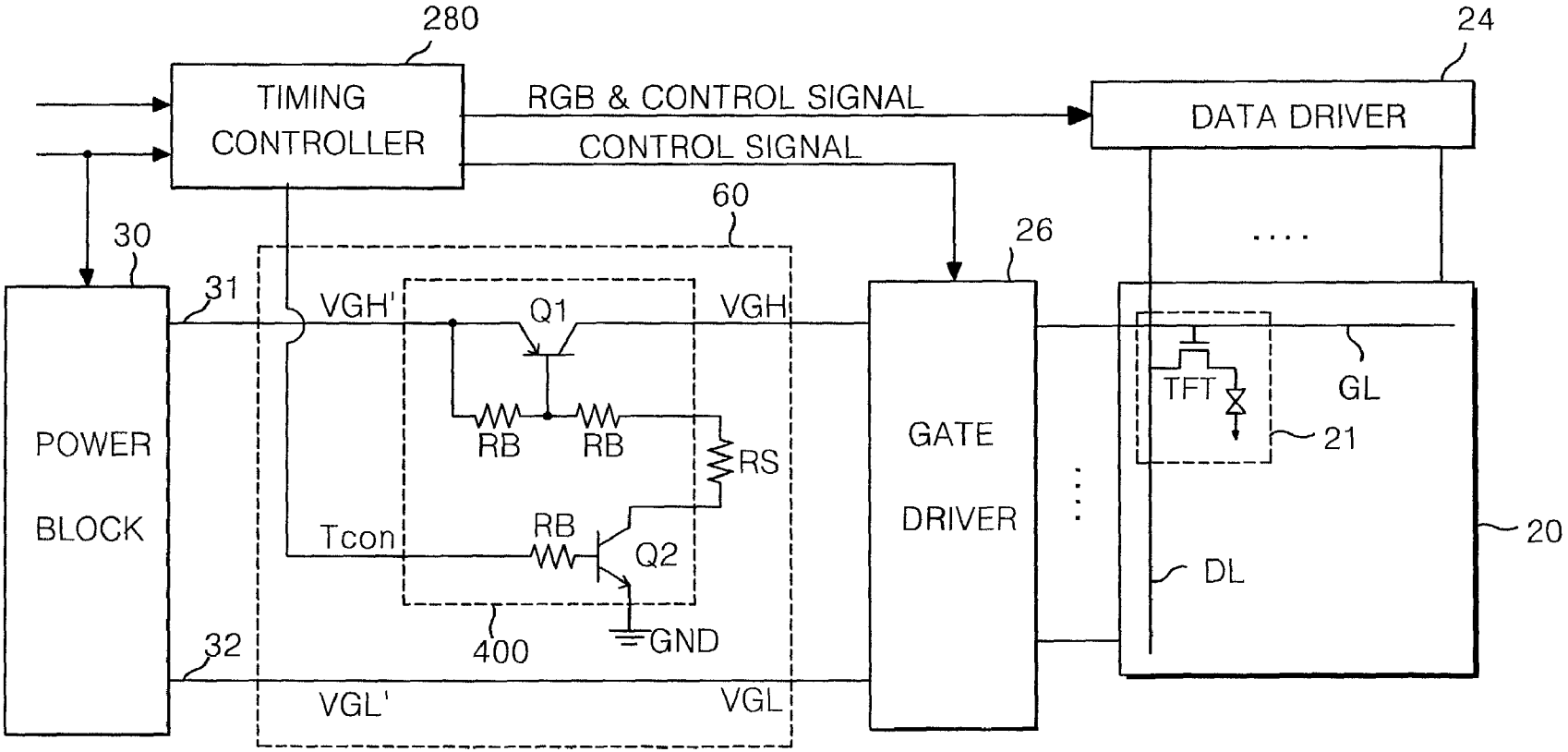
FIG. 6 is a circuit diagram of a power sequence apparatus usable with a liquid crystal display according to a second embodiment of the present invention.

Referring to FIG. 6, a power sequence apparatus 60 according to a second embodiment of the present invention includes a sequence control circuit 400 disposed between a gate driver 26 and a gate high voltage output line 31 of a power block 30, and a timing controller 280 for supplying a timing signal to the sequence control circuit 400.

The sequence control circuit 400 includes a first P-type transistor Q1 disposed between the gate driver 26 and the gate high voltage output line 31 of the power block 30, and a second N-type transistor Q2 disposed between the first P-type transistor Q1 and a ground voltage source GND.

A bias resistor RB is connected between the emitter terminal and the base terminal of the first P-type transistor Q1, and the second N-type transistor Q2 is coupled to the base terminal of the first transistor Q1. A current control resistor RS for controlling the switching speed of the first P-type transistor Q1 and protecting it is connected between the base terminal of the first transistor Q1 and the second N-type transistor Q2. Another bias resistor RB is connected between the base terminal of the first transistor Q1 and the current control resistor RS, and a third bias resistor RB is connected between the base terminal of the second transistor Q2 and the timing controller 280.

The emitter terminal of the second N-type transistor Q2 is connected to the ground voltage source GND, and the base terminal of the second transistor Q2 is coupled to the timing controller 280 through the bias resistor RB.

The timing controller 280 supplies to the base terminal of the second N-type transistor Q2 a timing control signal Tcon which is for turning on/off the second N-type transistor Q2. Also, as in the first embodiment, the timing controller 280 supplies control signals to the gate driver 26 for supplying a scanning signal to the liquid crystal display panel 20, and supplies the data driver 24 with control signals such as digital video data signals (R,G,B), a source sampling clock, etc.

Figure 7:
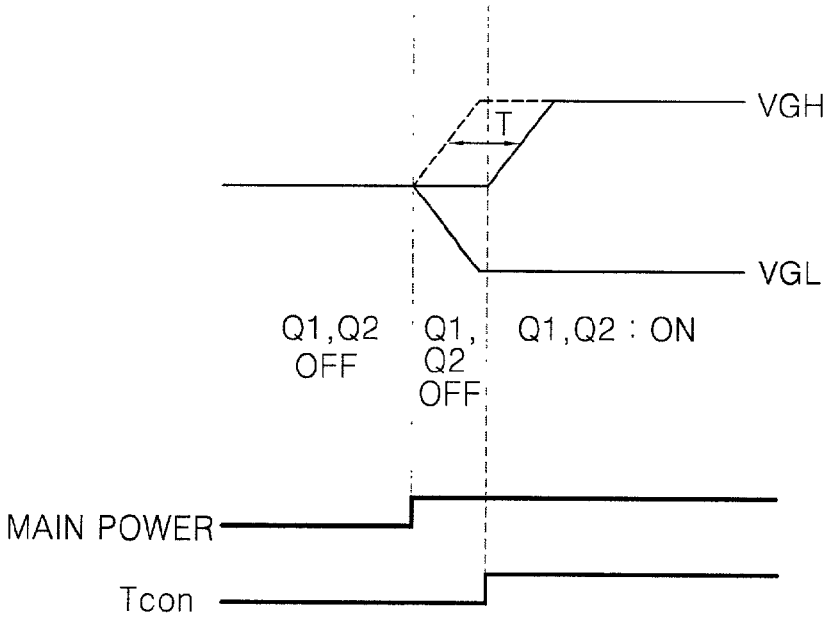
FIG. 7 is a waveform diagram representing a gate driving voltage in accordance with the drive of the power sequence apparatus shown in FIG. 6.

As shown in FIG. 7, the first P-type transistor Q1 and the second N-type transistor Q2 of the sequence control circuit 400 remain at the turned-off state before the main power is supplied to the power block 30. Once the main power is supplied to the power block 30, the gate driver 26 is provided immediately with the gate low voltage VGL through the gate low voltage output line 32. However, at this moment, the gate high voltage VGH' is blocked by the turned-off first P-type transistor Q1 and is not transmitted to the gate drive 26.

Then, the timing controller 280 provides the second N-type transistor Q2 with the timing control signal Tcon to turn on the second transistor Q2. Because the second N-type transistor Q2 is turned on by the timing control signal Tcon, the voltage on the base terminal of the first P-type transistor Q1 flows to the ground voltage source GND through the second N-type transistor Q2. Accordingly, the first P-type transistor Q1 is turned on because its threshold voltage gets lower. As a result, after a certain time (T) delay, the gate driver 26 is provided with the gate high voltage VGH by the operation the first P-type transistor Q1 through the output line 31 of the power block 30.

In this way, the power sequence apparatus 60 according to the second embodiment of the present invention controls the supply timing of the gate high voltage VGH to the gate driver 26 based on the timing control signal Tcon of the timing controller 280. Also, the apparatus 60 controls the supply timing of the gate high voltage VGH to the gate driver 26 by using the current control resistor RS disposed between the base terminal of the first P-type transistor Q1 and the collector terminal of the second N-type transistor Q2.

As a result, in the power sequence apparatus 60 according to the present invention, because the timing control signal Tcon is supplied from the timing controller 280 after the power block 30 is supplied with the main power and after the gate driver 26 is provided with the gate low voltage VGL, the gate high voltage VGH is always supplied after the gate low voltage VGL. Therefore, no malfunction occurs in the LCD because the gate driver 26 is always provided with the gate high voltage VGH after it receives the gate low voltage VGL.

In one embodiment, the sequence control circuit 40 or 400 can be integrated into a single integrated circuit. Further, it can be integrated to be used by separating each of the transistors Q1 and Q2 from the sequence control circuit 40 or 400, but can also to be packaged by integrating the power sequence apparatus 60 separately.

As described above, because the power sequence apparatus and a driving method for the power sequence apparatus according to the present invention uses a switching device to control the sequence of power application, it has an advantage of easily controlling the sequence of power being supplied to the driver IC. Also, by using the timing control signal of the timing controller, the gate high voltage is always supplied to the drive IC after the gate low voltage is supplied to the drive IC. This prevents occurrence of malfunction and error in the driver.

It should be understood to the ordinary skilled person in the art that the invention is not limited to the embodiments, but rather that various changes or modifications thereof are possible without departing from the spirit of the invention. Accordingly, the scope of the invention shall be determined by the appended claims and their equivalents.

What is claimed is:

1. A power sequence apparatus comprising:

a power supply for simultaneously generating a gate high voltage and a gate low voltage;

a device driving circuit for sequentially outputting the gate high voltage and then the gate low voltage; and a voltage controller, disposed between the power supply and the device driving circuit, for simultaneously receiving the gate high voltage and the gate low voltage from the power supply, and processing the gate high voltage using at least one pair of switching circuits to supply the gate high voltage to the device driving circuit after supplying the gate low voltage to the device driving circuit, wherein the switching circuits in the at least one pair are connected by a current control resistor.

2. The power sequence apparatus according to claim 1, wherein the voltage controller includes:

a first switching circuit disposed between the power supply and the device driving circuit to switch to the device driving circuit the gate high voltage that is output from the power supply; and a second switching circuit connected between the first switching circuit and a gate low voltage output line of the power supply to control a switching point of the first switching circuit.

3. The power sequence apparatus according to claim 2, wherein the voltage controller further includes:

a first resistor and a capacitor connected in parallel between the second switching circuit and the gate low voltage output line for switching the second switching circuit according to a RC time constant of the first resistor and the capacitor; and a second resistor connected between the second switching circuit and a ground voltage source for discharging a charged voltage of the capacitor to the ground voltage source.

4. The power sequence apparatus according to claim 2, wherein the voltage controller further includes:

a RC circuit disposed between the second switching circuit and the gate low voltage output line of the power supply.

5. The power sequence apparatus according to claim 2, wherein the first switching circuit and the second switching circuit are integrated into a single chip.

6. The power sequence apparatus according to claim 2, further comprising:

a current control resistor connected between the first switching circuit and the second switching circuit for controlling a switching speed of the first switching circuit.

7. The power sequence apparatus according to claim 2, wherein at least one of the first and second switching circuits includes a transistor.

8. A power sequence apparatus comprising:

a power supply for simultaneously generating a gate high voltage and a gate low voltage;

a device driving circuit for sequentially outputting the gate high voltage and the gate low voltage;

a switching part, disposed between the power supply and the device driving circuit, for simultaneously receiving the gate high voltage and the gate low voltage from the power supply, and switching the gate high voltage to supply the gate high voltage to the device driving circuit after supplying the gate low voltage to the device driving circuit; and a timing control part generating a switching control signal to the switching part to control a switching action of the switching part,wherein the switching part includes at least one pair of switching circuits which are connected by a current control resistor.

9. The power sequence apparatus according to claim 8, wherein the switching part includes:

a first switching circuit connected between the power supply and the device driving circuit for switching to the device driving circuit the gate high voltage output from the power supply; and a second switching circuit connected between the first switching circuit and a gate low voltage output line of the power supply for controlling a switching point of the first switching circuit according to the switching control signal from the timing control part.

10. The power sequence apparatus according to claim 9, wherein at least one of the first and second switching circuits includes a transistor.

11. The power sequence apparatus according to claim 8, wherein the timing control part supplies the switching control signal to the switching part after a driving power is supplied to the power supply and after the gate low voltage is supplied from the power supply to the device driving circuit.

12. A display device comprising:

a display panel for displaying an image;

a data driver for driving the display panel;

a power supply for simultaneously generating a gate high voltage and a gate low voltage;

a voltage controller for simultaneously receiving the gate high voltage and the gate low voltage and sequentially supplying the gate high voltage and the gate low voltage to a gate driver using first and second switching circuits; and the gate driver for sequentially supplying the gate high and low voltages output from the voltage controller to gate lines of the display panel, wherein the first and second switching circuits are connected by a current control resistor.

13. The display device according to claim 12, wherein the voltage controller includes:

the first switching circuit disposed between the power supply and the gate driver to switch to the gate driver the gate high voltage that is output from the power supply; and the second switching circuit connected between the first switching circuit and a gate low voltage output line of the power supply to control a switching point of the first switching circuit.

14. The display device according to claim 13, wherein the voltage controller further includes:

a first resistor and a capacitor connected in parallel between the second switching circuit and the gate low voltage output line for switching the second switching circuit according to a RC time constant of the first resistor and the capacitor; and a second resistor connected between the second switching circuit and a ground voltage source for discharging a charged voltage of the capacitor to the ground voltage source.

15. The display device according to claim 12, further comprising:

a current control resistor connected between the first switching circuit and the second switching circuit for controlling a switching speed of the first switching circuit.

16. The display device according to claim 12, wherein at least one of the first and second switching circuits includes a transistor.

17. A display device comprising:

a display panel for displaying an image;

a data driver for driving the display panel;

a power supply for simultaneously generating a gate high voltage and a gate low voltage;

a gate driving circuit sequentially supplying the gate high voltage and the gate low voltage to gate lines of the display panel;

a switching part, disposed between the power supply and the gate driving circuit, for simultaneously receiving the gate high voltage and the gate low voltage and switching the gate high voltage to supply the gate high voltage to the gate driving circuit after supplying the gate low voltage to the gate driving circuit; and a timing control part generating a switching control signal to the switching part to control a switching action of the switching part, wherein the switching part includes at least one pair of switching circuits which are connected by a current control resistor.

18. The display device according to claim 17, wherein the switching part includes:

a first switching circuit connected between the power supply and the gate driving circuit for switching to the gate driving circuit the gate high voltage output from the power supply; and a second switching circuit connected between the first switching circuit and a gate low voltage output line of the power supply for controlling a switching point of the first switching circuit according to the switching control signal from the timing control part.

19. The display device according to claim 18, wherein at least one of the first and second switching circuits includes a transistor.

20. A method of driving a power sequence apparatus, comprising the steps of:

generating a gate high voltage and a gate low voltage;

simultaneously receiving the gate high voltage and the gate low voltage and supplying the gate high voltage to a gate driving circuit by using at least one pair of switching circuits connected by current control resistor to switch the gate high voltage after supplying the gate low voltage to the gate driving circuit; and sequentially supplying the gate low voltage and the gate high voltage to a plurality of electrodes.

* * * * *